United States Patent [19]

Christ et al.

[11] 4,108,801

[45] Aug. 22, 1978

[54] DETERGENT COMPOSITIONS AND PROCESSES UTILIZING SAME

[75] Inventors: Thomas Christ, O'Fallon, Ill.; Robert P. Langguth, Overland, Mo.

[73] Assignee: Monsanto Company, St. Louis, Mo.

[21] Appl. No.: 755,098

[22] Filed: Dec. 28, 1976

[51] Int. Cl.[2] ..... C11D 1/02; C11D 3/08

[52] U.S. Cl. ..... 252/544; 8/137; 252/556; 252/558; 252/DIG. 11

[58] Field of Search ..... 252/544, 558, 556, 8.7, 252/89 R, DIG. 11; 8/137

[56] References Cited

U.S. PATENT DOCUMENTS 3,865,755 2/1975 Lannert ..... 252/558

*Primary Examiner*—Thomas J. Herbert, Jr.
*Attorney, Agent, or Firm*—S. M. Tarter; E. P. Grattan; F. D. Shearin

[57] ABSTRACT

A detergent composition comprising:

a. a blend of linear alkyl benzene sulfonate detergent components, the blend comprising approximately equal amounts by weight of one linear alkyl benzene sulfonate having an average number of carbons in the alkyl chain of about 13-14, and a second linear alkyl benzene sulfonate having an average number of carbons in the alkyl chain of about 11-12, and b. in admixture with the blend of linear alkyl benzene sulfonates, from about 5 to 95% by weight of a builder compound represented by the formula:

wherein M is selected from the group consisting of alkali metal, ammonium and trialkanolammonium.

The composition may also desirably contain other builders such as, sodium carbonate, zeolites, synthetic alumino silicates, etc.

14 Claims, 2 Drawing Figures

FIG I

COTTON DETERGENCY OF 33% AND 20% BUILDER FORMULATIONS AS A FUNCTION OF ALKYLATE TYPE AND HARDNESS AT 120°F (DETG. CONC. = 0.12%)

PERMANENT PRESS PE/COTTON DETERGENCY OF 33% AND 20% BUILDER FORMULATIONS AS A FUNCTION OF ALKYLATE TYPE AND HARDNESS AT 120°F (DETG. CONC. = 0.12%)

DETERGENT COMPOSITIONS AND PROCESSES UTILIZING SAME

BACKGROUND OF THE INVENTION

It has recently been found that compounds of the following formula are useful non-phosphorus builders in a variety of detergent formulations:

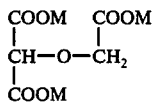

wherein M is alkali metal, $NH_4^+$ or $NH^+(CH_2CH_2OH)_3$. The use of such compounds as detergency builders is described in U.S. Pat. No. 3,865,755 and the disclosure of that patent is expressly incorporated herein by reference.

Linear alkyl benzene sulfonates have also been widely employed as active components in a wide variety of detergent formulations.

As the result of extensive research it has now been found that surprisingly improved detergency performance can be achieved with formulations comprising a blend of linear alkyl benzene sulfonates of specified carbon chain length when used in admixture with builders of the type set forth in the above formula.

SUMMARY OF THE INVENTION

The present invention comprises detergent compositions comprising a mixture of:

a. an approximately 50/50 by weight blend of linear alkyl benzene sulfonates, one having an average number of carbons in the alkyl chain of about 13–14 and a second having an average number of carbon atoms in the alkyl chain of about 11–12, b. from about 5 to 95% by weight based upon the weight of the blend of sulfonates of a compound(s) of the formula:

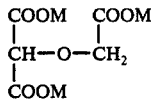

wherein M is alkali metal, $NH_4^+$ or $NH^+(CH_2CH_2OH)_3$, and c. other optional ingredients.

DETAILED DESCRIPTION OF THE INVENTION

Figure 1:
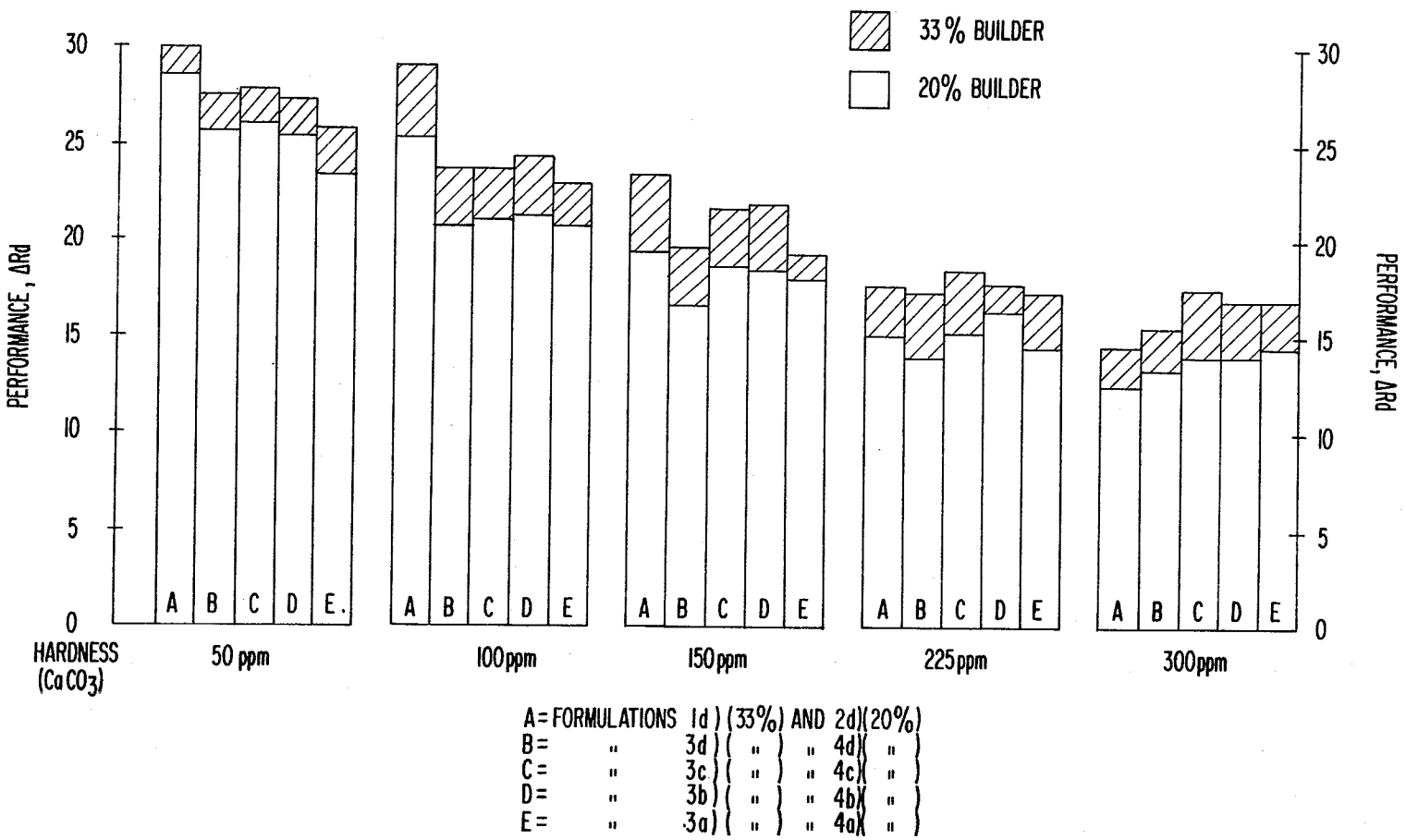

Detergency performance for detergent formulations is measured by a number of tests including synthetic sebum/airborne particulate soil removal, particulate clay soil removal, and food stain removal on both cotton and permanent press polyester/cotton fabric. For many years sodium tripolyphosphate (STP) has been used as a detergent builder and is still the builder of choice in most laundry detergent formulations and many other detergent compositions. Efforts have been made in recent years, however, to develop non-phosphorus builder compounds as partial or total replacements for STP.

In the course of such research and development effective non-phosphorus builder compounds have been discovered which have the formula:

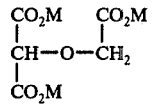

wherein M is as set forth above.

It has now been found that particularly effective detergent formulations comprise the foregoing builder compounds mixed with a blend of linear alkyl benzene sulfonates, one having an average number of carbons in the alkyl chain of about 13–24, and another having an average number of carbons in the alkyl chain of about 11–12, the average carbon number for the blend being 12–13.

In tests comparing detergency performance of the compositions of the invention with the performance of STP containing compositions, the present compositions were found to be at least equivalent to the STP standard for clay particulate soil removal and food stain removal (except for tea stain). The compositions proved to be effective but somewhat less so than the STP standard in the soft water/sebum soil removal test, but this deficiency was overcome by a further addition of sodium carbonate to the formulation.

Linear alkyl benzene sulfonates are well known anionic surfactants which have been widely used in detergent compositions and are preferred for use in general laundry formulations. The most commonly used linear alkyl benzene sulfonates have alkyl groups containing from 10 to 16 carbon atoms.

According to the present invention one linear alkyl benzene sulfonate having an average carbon number (i.e., number of carbon atoms in the alkyl chain) of 13–14, preferably about 13.3, is blended with a second linear alkyl benzene sulfonate having a carbon number of 11–12, preferably about 11.6, to give a mixture having an average carbon number of 12–13, preferably 12.5. This blend is obtained by mixing the two sulfonates in an approximately 1/1 ratio by weight.

The builder compound is preferably used in the sodium salt form:

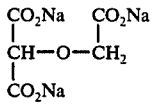

but the other alkali metal, ammonium and triethanolamine salts of the compound may also be employed.

While the sulfonate blend and builder are the two essential ingredients of the present detergent formulations, the compositions also may advantageously comprise sodium carbonate as a synergistic builder component.

The detergent formulations contain at least 1% by weight and preferably at least 5% by weight of the basic builder compound. The use of from 5% to 75% of these compositions is particularly preferred.

By way of example, in addition to sodium carbonate, builders which can be employed in combination with the novel builder compounds of this invention include water soluble inorganic builder salts such as alkali metal polyphosphates, i.e., the tripolyphosphates and pyrophosphates; alkali metal borates, bicarbonates, silicates, water insoluble alumino silicates, e.g., as described in German Patent No. 2,433,485, and water soluble organic builders including amino polycarboxylic acids and salts such as alkali metal nitrilotriacetates, cycloalkane polycarboxylic acids and salts, ether polycarboxylates, for example:

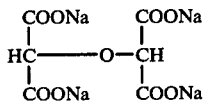

alkyl polycarboxylates, epoxy polycarboxylates, tetrahydrofuran polycarboxylates such as 1,2,3,4- or 2,2,5,5-tetrahydrofuran tetracarboxylates, benzene polycarboxylates, oxidized starches, amino(trimethylene phosphonic acid) and its salts, diphosphonic acids and salts (e.g., methylene diphosphonic acid; 1-hydroxy ethylidene diphosphonic acid) and the like, synthetic alkali alumino silicates, zeolites, etc.

The detergent formulations will generally contain from 5% to 95% by weight total builder (although greater or lesser quantities may be employed if desired) which, as indicated above, may be solely the builder compounds of this invention or mixtures of such compositions with other builders. The total amount of builder employed will be dependent on the intended use of the detergent formulation, other ingredients of the formulation, pH conditions and the like. For example, general laundry powder formulations will usually contain 20% to 60% builder. Optimum levels of builder content as well as optimum mixtures of builders of this invention with other builders for various uses can be determined by routine tests in accordance with conventional detergent formulation practice.

The detergent formulations will generally contain up to about 50% of the above-described blend of linear alkyl benzene sulfonates as the essential surfactant component of the formulations.

Other anionic, nonionic, zwitterionic and amphoteric surfactants may also be present in the composition.

Examples of suitable anionic surfactants include soaps such as the salts of fatty acids containing about 9 to 20 carbon atoms, e.g., salts of fatty acids derived from coconut oil and tallow; alcohol sulfates; ethoxylated alcohol sulfates; hydroxy alkyl sulfonates; alkenyl and alkyl sulfates and sulfonates; monoglyceride sulfates; acid condensates of fatty acid chlorides with hydroxy alkyl sulfonates and the like.

Examples of suitable nonionic surfactants include alkylene oxides (e.g., ethylene oxide condensates of mono- and polyhydroxy alcohols, alkyl phenols, fatty acid amides) and fatty amines; amine oxides; sugar derivatives such as sucrose monopalmitate; long-chain tertiary phosphine oxides; dialkyl sulfoxides; fatty acid amides, (e.g., mono- or diethanol amides of fatty acids containing 10 to 18 carbon atoms), and the like.

Examples of suitable zwitterionic surfactants include derivatives of aliphatic quaternary ammonium compounds such as 3-(N,N-dimethyl-N-hexadecyl ammonio)propane-1-sulfonate and 3-(N,N-dimethyl-N-hexadecyl ammonio)-2-hydroxy propane-1-sulfonate.

Examples of suitable amphoteric surfactants include betaines, sulfobetaines and fatty acid imidazole carboxylates and sulfonates.

It will be understood that the above examples of surfactants are by no means comprehensive and that numerous other surfactants are known to those skilled in the art. It will be further understood that the choice and use of surfactants will be in accordance with well-understood practices of detergent formulation.

The quantity of surfactant employed in the detergent formulations will depend on the surfactant chosen and the end use of the formulation. In general, the formulations will contain from 5% to 50% surfactant by weight, although as much as 95% or more surfactant may be employed if desired. For example, general laundry powder formulations normally contain 5% to 50%, preferably 15% to 25% surfactant. The weight ratio of surfactant to builder will generally be in the range of from 1:12 to 2:1.

In addition to builder and surfactant components, detergent formulations may contain fillers such as sodium sulfate and minor amounts of bleaches, dyes, optical brighteners, soil anti-redeposition agents, perfumes and the like.

The invention is further illustrated by the following examples wherein all percentages are by weight unless otherwise indicated.

EXAMPLE 1

The following detergent formulations were prepared by conventional mixing of the listed ingredients:

| | Formulation No. | | | |
|---|---|---|---|---|
| | 1 | 2 | 3 | 4 |
| Linear Alkyl Benzene Sulfonate (a,b,c, or d) | 18% | 18% | 18% | 18% |
| Builder: | | | | |
| -trisodium salt of invention | | | 33% | 20% |
| -STP | 33% | 20% | | |
| Sodium Silicate (47%) | 12% | 12% | 12% | 12% |
| Carboxy Methyl Cellulose | 1% | 1% | 1% | 1% |
| $Na_2SO_4$ | 36% | 49% | 36% | 49% |

In the above formulations the linear alkyl benzene sulfonate component was varied, being selected from among the following four choices:

a. a 50/50 blend of linear alkyl benzene sulfonates, one having an average molecular weight (as measured by GLC analysis) of 235.3 and an average carbon number of 11.2 and another having an average molecular weight of 240.4 and an average carbon number of 11.6, b. unblended linear alkyl benzene sulfonate having an average molecular weight of 240.4 and an average carbon number of 11.6, c. a 50/50 blend of linear alkyl benzene sulfonates, one having an average molecular weight of about 264 and an average carbon number of 13.3, another having an average molecular weight of about 240 and an average carbon number of 11.6, and d. unblended linear alkyl benzene sulfonate having an average molecular weight of 264.4 and an average carbon number of 13.3.

The compositions were tested for synthetic sebum-/airborne particulate removal from soiled cotton and permanent press cotton/polyester fabrics in water of varying temperature and hardness. The following washing conditions were used:

| | |
|---|---|
| Temperature | −120° F and 70° F. |
| Detergent Concentration | −0.12% |
| Water Hardness (ppm $CaCO_3$) | −50, 100, 150, 225 and 300 ppm. |

Figure 2:
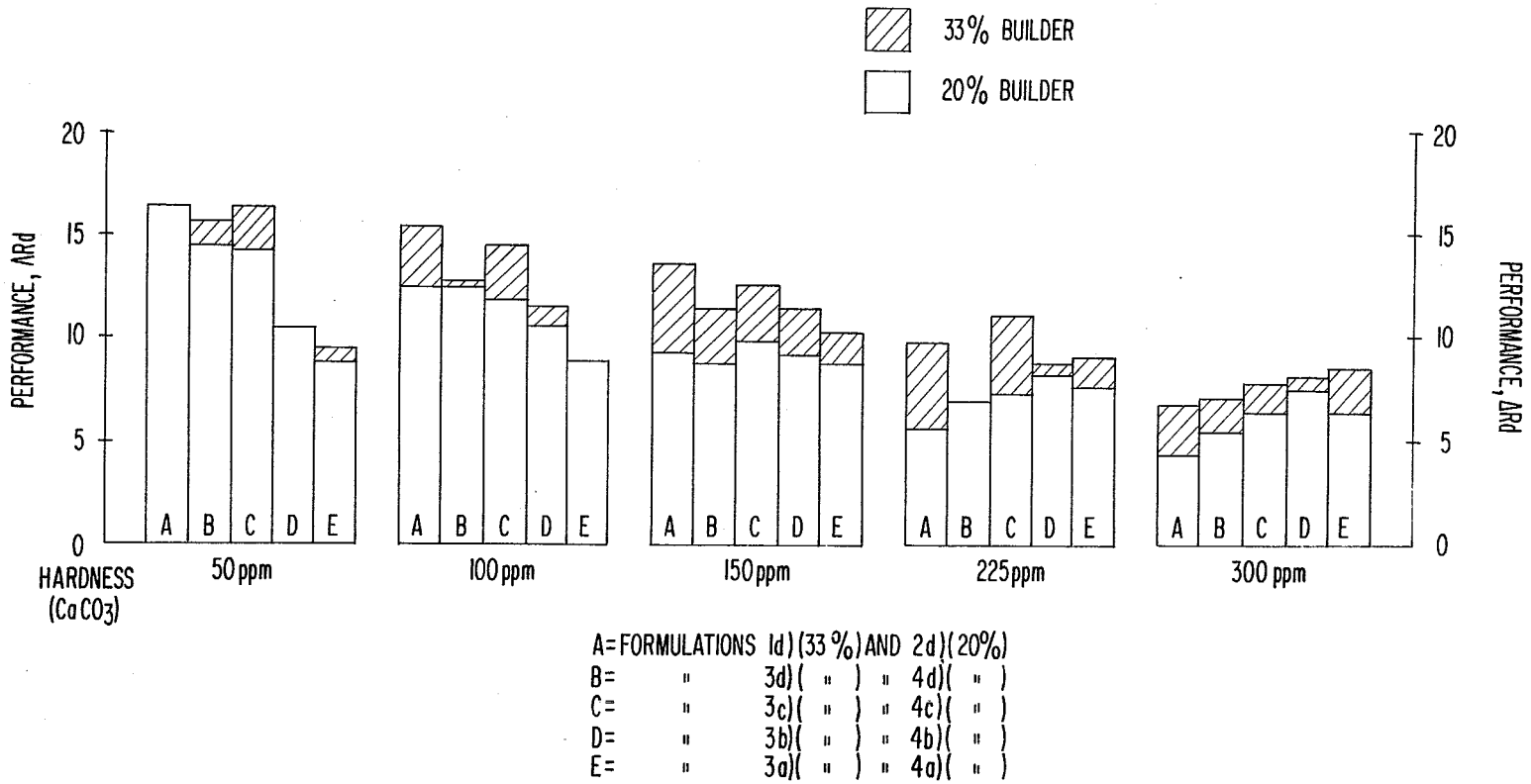

The results of the foregoing tests are reported graphically in FIGS. 1 and 2. Detergency performance in these tests was measured optically on a reflectometer.

The difference in reflectivity of washed and unwashed samples was measured and is represented by the data by Δ Rd. Higher Δ Rd values are indicative of superior cleaning performance with differences of 1.5 or more being considered significant.

While STP outperformed the various detergents comprising the surfactant/builder compositions of the invention and other linear alkyl benzene sulfonate/-builder compositions tested for comparison at relatively lower water hardness levels (soft water), i.e., 50, 100 and 150 ppm $CaCO_3$, the compositions of the invention, Formulations 1c), 2c), 3c) and 4c) proved overall to be most effective for both cotton and permanent press polyester/cotton fabrics. In FIG. 1, the compositions of the invention outperformed STP and the other linear alkyl benzene sulfonate/builder formulations at the higher hardness levels, 225 and 300 ppm $CaCO_3$. The compositions+ performance was generally superior to or comparable to the comparative sulfonate/builder compositions at all hardness levels. In the data in FIG. 2, on permanent press polyester/cotton fabric the compositions of the invention were again shown to be superior to STP at the higher (225, 300 ppm $CaCO_3$) hardness levels and were superior to all comparative sulfonate/builder compositions at 50, 100, 150 and 225 ppm $CaCO_3$ and roughly comparable at 300 ppm $CaCO_3$.

On balance, therefore, the compositions of the invention showed surprisingly more effective overall performance on both cotton and permanent press fabrics in comparison with other similar sulfonate/builder formulations and even outperformed STP at high water hardness levels.

The sebum soil performance of the sulfonate/builder formulations of this invention can be brought up to levels comparable with the performance of STP containing formulations by the addition sodium carbonate. The amount of sodium carbonate is generally from about 5 to 40% and preferably from about 5 to 20% by weight of the combined weight of builder plus sodium carbonate. Improvement of the performance of the compositions of the invention in the sebum soil test at low hardness levels so as to match the performance of the STP formulations was achieved by the addition of 6% $Na_2CO_3$ by weight of the total detergent formulation.

Various changes in detergency, and the alkalinity and corrosion properties of aqueous compositions of the invention can be effected by adjustments in the amounts of the optional ingredients of the formulation. A desirable formulation exhibiting improved detergency at low hardness levels and a favorable alkalinity/low corrosion balance has been found to comprise approximately the following amounts:

| | % by Weight | |
|---|---|---|
| | Range | Preferred |
| Linear alkyl benzene sulfonate blend | 15–20 | 18 |
| Builder ($C_5H_3O_7Na_3$) | 30–35 | 33 |
| Sodium Silicate (47%) | 5–15 | 6 |
| Carboxymethyl cellulose | 0–2 | 1 |
| Sodium sulfate | 30–40 | 36 |
| Sodium carbonate | 5–20 | 6 |

The preferred formulation set forth above gave detergency performance equivalent to STP formulations on cotton and permanent press fabrics washed in soft water at 120° F., where free builder is present and gave slightly better performance on cotton and significantly better performance on permanent press fabric in water where free hardness exists.

The processes of the invention comprise standard washing operations in which articles to be cleaned are contacted with aqueous compositions containing the detergent compositions of the invention.

What is claimed is:

1. A composition comprising: a. a blend of linear alkyl benzene sulfonates in approximately 1/1 ration by weight, one of said sulfonates having an average carbon number in the alkyl chain of 13–14 and a second of said sulfonates having an average carbon number in the alkyl chain of 11–12, the average carbon number in the alkyl chains of said blend being 12–13, and b. at least 5% by weight of said blend of a compound of the formula:

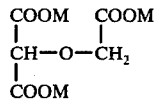

wherein M is selected from the group consisting of alkali metal, ammonium, and $NH+(Ch_2CH_2OH)_3$.

2. The composition of claim 1 wherein said compound is present in an amount of from 5 to 95% of said composition.

3. The composition of claim 1 wherein said compound is present in an amount of from 20 to 60% of said composition.

4. The composition of claim 1 further comprising from 5 to 40% by weight of sodium carbonate.

5. The composition of claim 1 further comprising sodium sulfate.

6. The composition of claim 1 further comprising sodium silicate.

7. The composition of claim 1 further comprising carboxy methyl cellulose.

8. The composition of claim 1 further comprising sodium sulfate, sodium silicate and carboxy methyl cellulose.

9. The composition of claim 4 further comprising sodium sulfate.

10. The composition of claim 4 further comprising sodium silicate.

11. The composition of claim 4 further comprising carboxy methyl cellulose.

12. The composition of claim 1 wherein said sulfonate blend is present in an amount of from 15 to 20%, said compound is present in an amount of 30 to 35% and said composition further comprises from 5 to 15% of sodium silicate, from 0 to 2% of carboxy methyl cellulose, from 30 to 40% of sodium sulfate, and from 5 to 20% of sodium carbonate.

13. The composition of claim 12 comprising approximately 18% of said sulfonate blend, 33% of said compound, 6% of said sodium silicate, 1% of said carboxy methyl cellulose, 36% of said sodium sulfate, and 6% of sodium carbonate.

14. A process for washing soiled articles comprising contacting said articles with an aqueous solution of the composition of claim 1.

* * * * *